US007066753B1

(12) United States Patent
Tseng

(10) Patent No.: US 7,066,753 B1
(45) Date of Patent: Jun. 27, 2006

(54) ELECTRONIC DEVICE CAPABLE OF MULTIDIRECTIONAL ROTATION

(75) Inventor: Yi-Wen Tseng, Taipei (TW)

(73) Assignee: Askey Computer Corp., Taipei (TW)

( * ) Notice: Subject to any disclaimer, the term of this patent is extended or adjusted under 35 U.S.C. 154(b) by 0 days.

(21) Appl. No.: 11/179,494

(22) Filed: Jul. 13, 2005

(51) Int. Cl.
*H01R 13/15* (2006.01)

(52) U.S. Cl. ..... 439/259

(58) Field of Classification Search ..... 439/8, 439/7, 6, 9, 640, 269, 259
See application file for complete search history.

(56) References Cited

U.S. PATENT DOCUMENTS 6,544,075 B1 4/2003 Liao
6,786,743 B1 * 9/2004 Huang ..... 439/131
6,893,267 B1 * 5/2005 Yueh ..... 439/8

* cited by examiner

*Primary Examiner*—Phuong Dinh
(74) *Attorney, Agent, or Firm*—Bacon & Thomas, PLLC

(57) ABSTRACT

An electronic device, which is capable of multidirectional rotation, includes a connecting unit, which has a connecting portion at one end detachably connectable to an external electronic device and a spherical ball socket at an opposite end, and a body unit having a housing and an electronic circuit assembly mounted inside the housing. The housing has a coupling structure that receives the spherical ball socket for allowing rotation of the spherical ball socket relative to the housing.

12 Claims, 5 Drawing Sheets

ELECTRONIC DEVICE CAPABLE OF MULTIDIRECTIONAL ROTATION

BACKGROUND OF THE INVENTION

1. Field of the Invention

The present invention relates to electronic devices and more specifically, to an electronic device capable of multidirectional rotation.

2. Description of the Related Art

When electrically connecting a first electronic device to a second electronic device, the first electronic device may be required to be rotatable relative to the second electronic device to fit the surroundings.

Conventionally, the transmission of signal adopts the stable wired signal transmitting method. However, following fast development of wireless transmission technology, wireless signal transmitting methods have been intensively used in electronic devices to substitute for the conventional wired signal transmitting method.

U.S. Pat. No. 6,544,075 discloses a rotatable folding-type wireless network card that allows angular adjustment in two directions to adjust the antenna to an optimum receiving position. According to this design, a female connecting portion is coupled to a male connecting portion for allowing rotation in a first direction within 90°, and a shaft connects the male connecting portion to the antenna for biasing in a second direction. This complicated coupling structure uses too many parts, resulting in a complicated installation procedure and a high manufacturing cost. Further, the complicated two-step adjustment procedure of adjusting the antenna to the desired angle is still not convenient to the user.

SUMMARY OF THE INVENTION

The present invention has been accomplished under the circumstances in view. It is the main object of the present invention to provide a multidirection rotatable electronic device, which uses a single coupling structure to achieve multidirectional rotation adjustment, thereby saving component parts and cost.

To achieve this object of the present invention, the electronic device comprises a connecting unit having a connecting portion, which is disposed at one end thereof and connectable to an external electronic device, and a pivoting portion having substantially a spherical contour disposed an opposite end thereof, and a body unit. The body unit includes a housing and an electronic circuit assembly mounted inside the housing. The housing has a coupling structure for receiving the pivoting portion of the connecting unit for allowing rotation of the pivoting portion of the connecting unit relative to the housing.

DETAILED DESCRIPTION OF THE INVENTION

Figure 1:
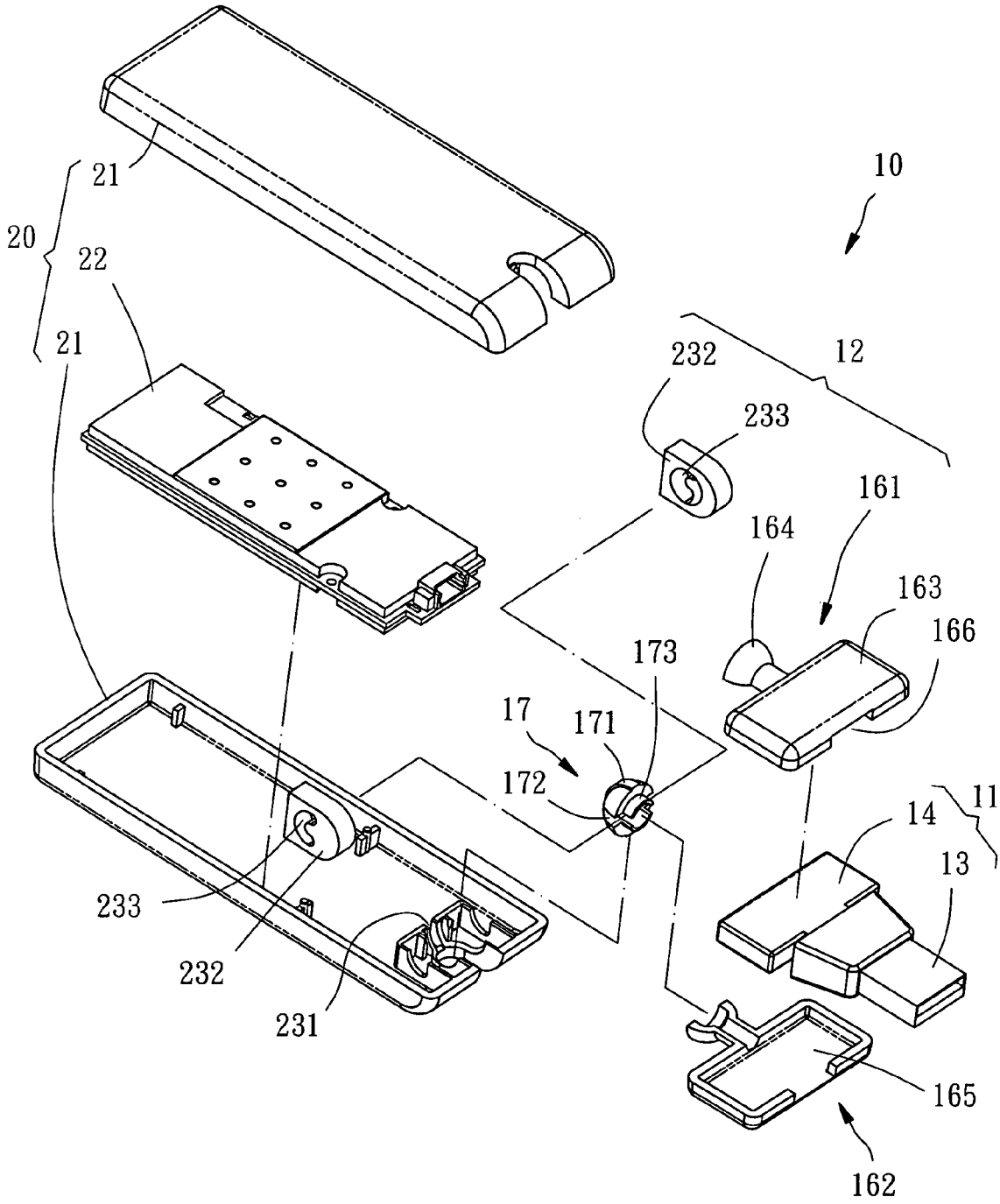
FIG. 1 is an exploded view of a preferred embodiment of the present invention.
Figure 2:
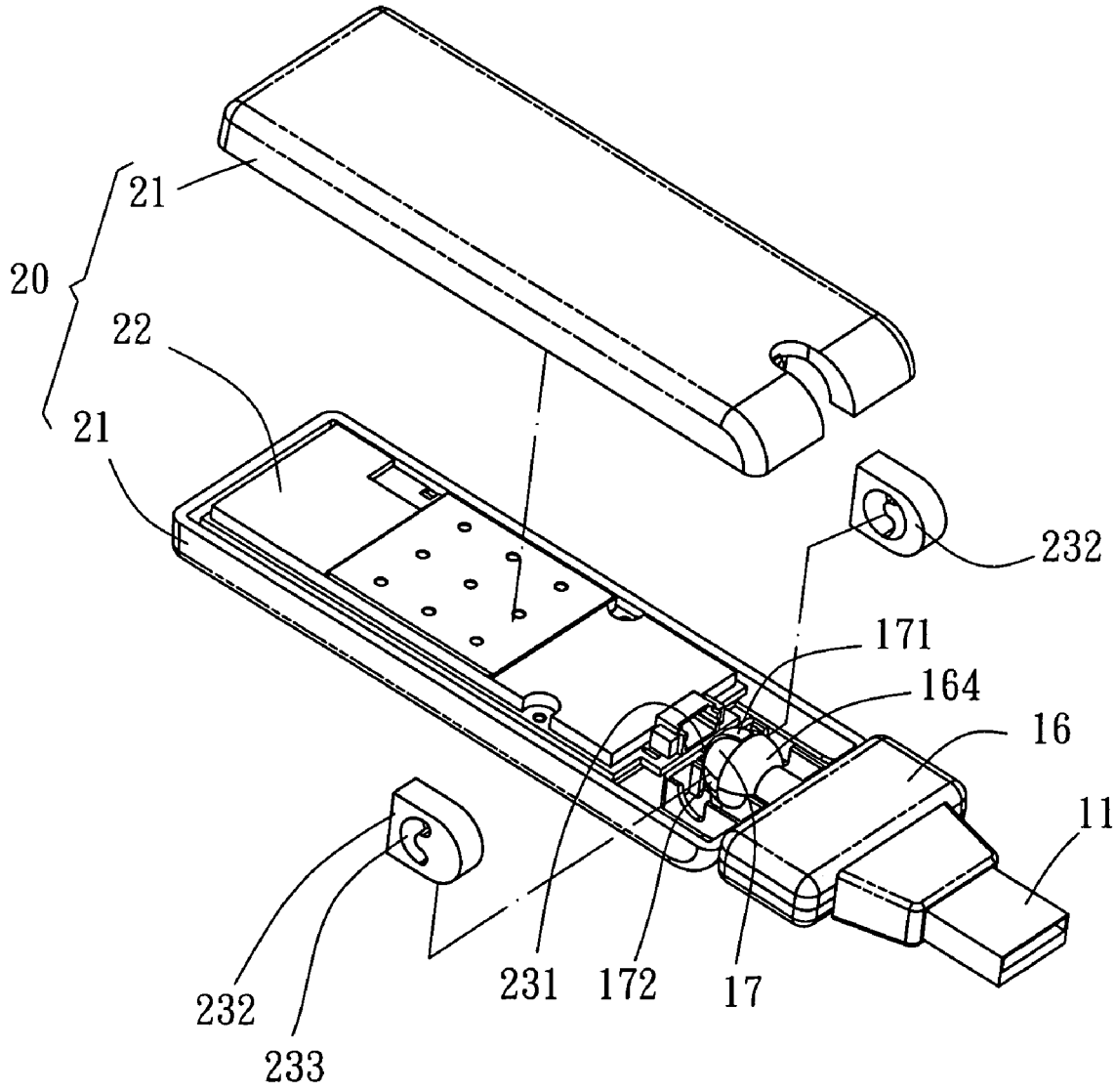
FIG. 2 corresponds to FIG. 1, showing a part of the electronic device assembled.
Figure 3:
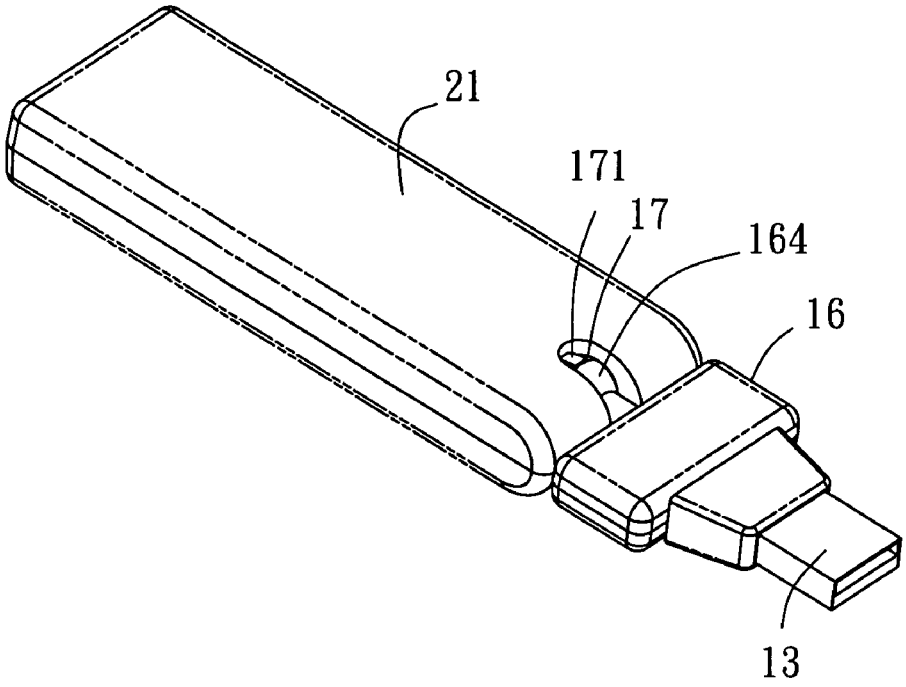
FIG. 3 is a perspective assembly view of the preferred embodiment of the present invention.
Figure 4:
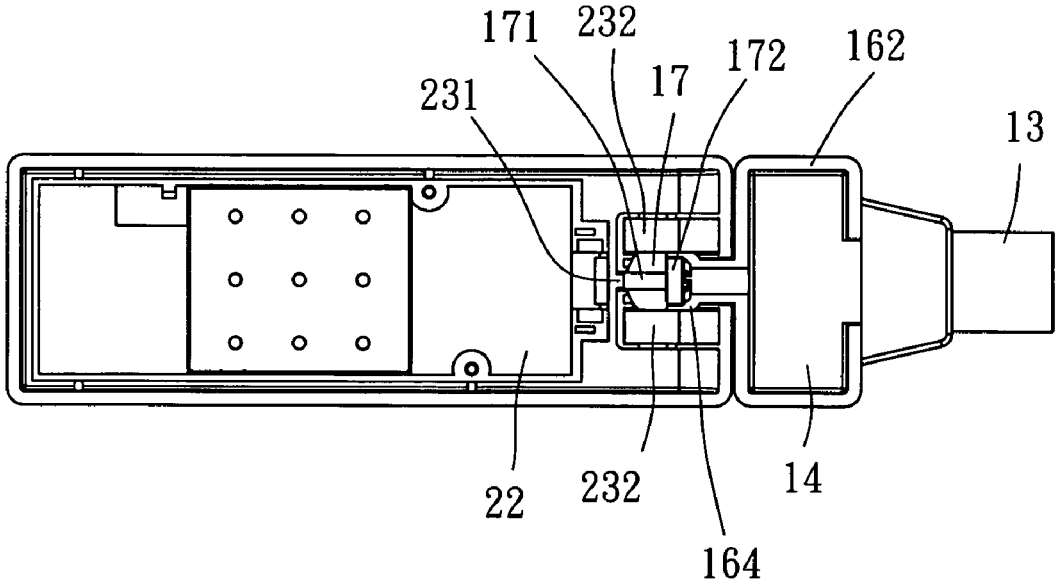
FIG. 4 is a top view in section of the preferred embodiment of the present invention.
Figure 5:
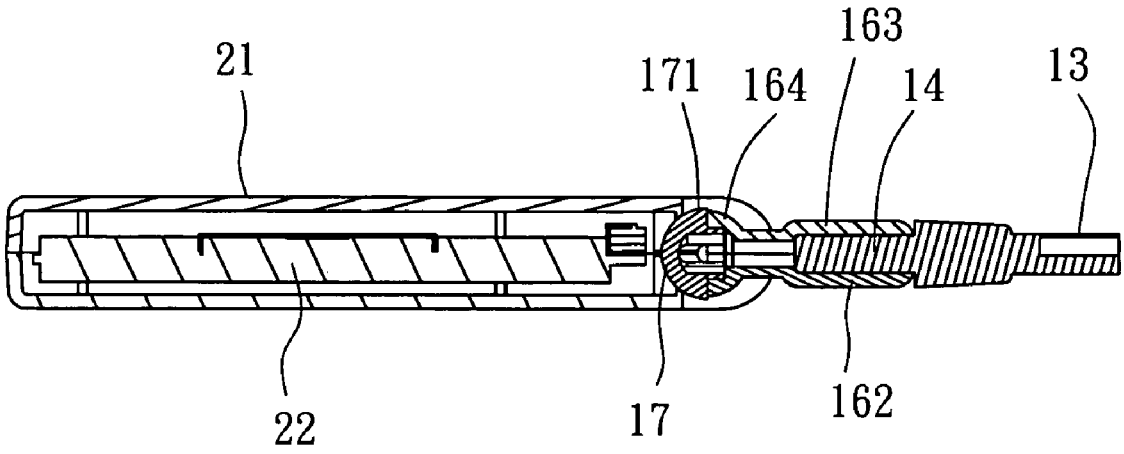
FIG. 5 is a side view in section of the preferred embodiment of the present invention.

Referring to FIGS. 1–5, a multidirection rotatable electronic device in accordance with the present invention is shown comprised of a connecting unit 10 and a body unit 20.

The connecting unit 10 comprises a connecting member 11 and an adapter 12. The connecting member 11 has a front connecting portion 13 made in the form of, for example, a USB (universal serial bus) plug, and a rear mounting portion 14 at the back side of the front connecting portion 13. The adapter 12 is comprised of a coupling member 16 and a limiter 17. The coupling member 16 is formed of two symmetrical half shells 161 and 162, having a hollow base 163, a pivoting portion 164 backwardly extending from the back side of the base 163, an accommodating chamber 165 defined in the hollow base 163, and a front opening 166 at the front side of the hollow base 163 in communication with the accommodating chamber 165. The pivoting portion 164 is a semispherical ball socket in this preferred embodiment. The rear mounting portion 14 of the connecting member 11 is received in the accommodating chamber 165 of the coupling member 16. The front connecting portion 13 of the connecting member 11 extends out of the hollow base 163 of the coupling member 16 through the front opening 166. The limier 17 is a hollow, semispherical member having a rib 171 protruded from the periphery of the semispherical body thereof, a neck 173 perpendicularly extending from the flat bottom wall thereof, and longitudinal crevices 172 cut through the tubular neck 173 at two sides. The tubular neck 173 is coupled to the pivoting portion 164 of the coupling member 16, allowing free rotation of the limiter 17 relative to the coupling member 16.

The body unit 20 comprises a housing 21 and an electronic circuit assembly 22. The housing 21 has a coupling structure 23. The coupling structure 23 comprises a locating groove 231 formed in the front side of the housing 21 for receiving the ribs 171 of the limiter 17, and two bearing blocks 232 bilaterally fixedly provided inside the housing 21 for supporting the pivoting portion 164 of the coupling member 16 and the limiter 17 in the coupling member 16. The bearing blocks 232 each have an arched slot 233. The electronic circuit assembly 22 is a transmitter receiver circuit board mounted inside the housing 21 for transmitting and receiving specific wireless signal.

The use and advantages of the present invention will be fully understood from the following description.

Figure 6:
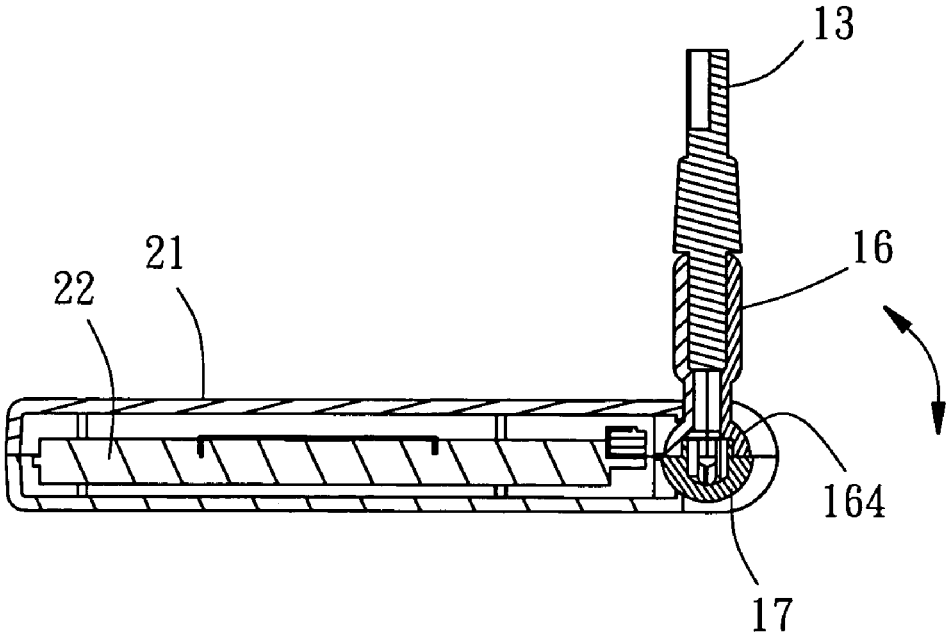
FIG. 6 is a schematic drawing showing one adjustment example of the present invention.
Figure 7:
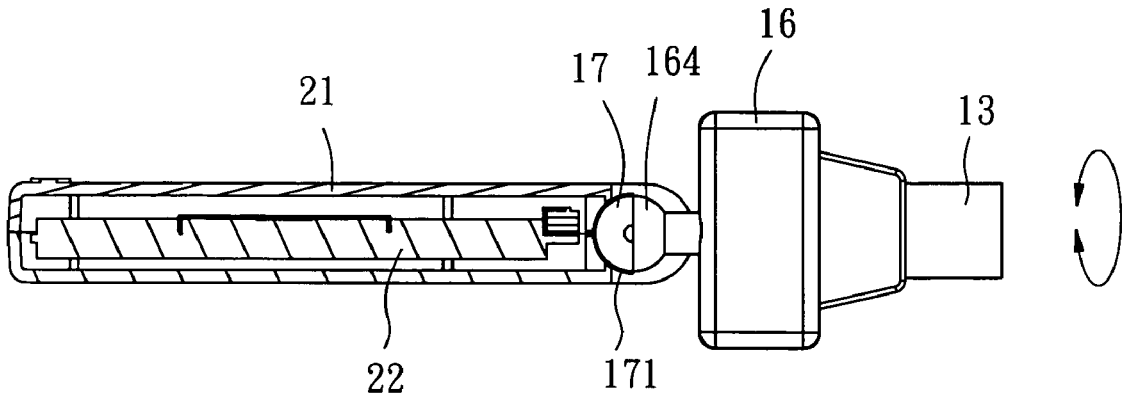
FIG. 7 is a schematic drawing showing another adjustment example of the present invention.

At first, the two half shells 161 and 162 are attached to the connecting member 11 and fastened together to have rear mounting portion 14 of the connecting member 11 be received in the accommodating chamber 165 of the coupling member 16 and the front connecting portion 13 extend out of the coupling member 16 through the front opening 166, and then the tubular neck 173 of the limiter 17 is inserted into the pivoting portion 164 of the coupling member 16 with force for allowing free rotation of the limiter 17 relative to the coupling member 16, and then the pivoting portion 164 with the limiter 17 are set in the coupling structure 23 of the housing 21 and supported between the bearing blocks 232 to have the rib 171 of the limiter 17 be engaged in the locating groove 231 of the coupling structure 23 to limit turning of the limiter 17 relative to the housing 21 to a vertical direction (see FIG. 6). When assembled, the crevices 172 of the limiter 17 are constantly kept in communication with the arched slots 233 of the bearing block 232 for the passing of an electric wire that connects the electric contacts (not shown) in the connecting member 11 to the electronic circuit assembly 22. This electric wire (not shown) has one end electrically connected to the electronic circuit assembly 22, and the other end inserted in proper order through the arched slots 233 of the bearing blocks 232 and the crevices 172 of the limiter 17 into the pivoting portion 164 and then extended through the hollow base 163 of the coupling member 16 into the front connecting portion 13 of the connecting member 11 and electrically connected to the electric contacts in the connecting portion 13 of the connecting member 11. Further, as shown in FIG. 7, the coupling member 16 can be rotated over 360° relative to the limiter 17, i.e., the connecting unit 10 can be rotated over 360° relative to the housing 21.

Figure 8:
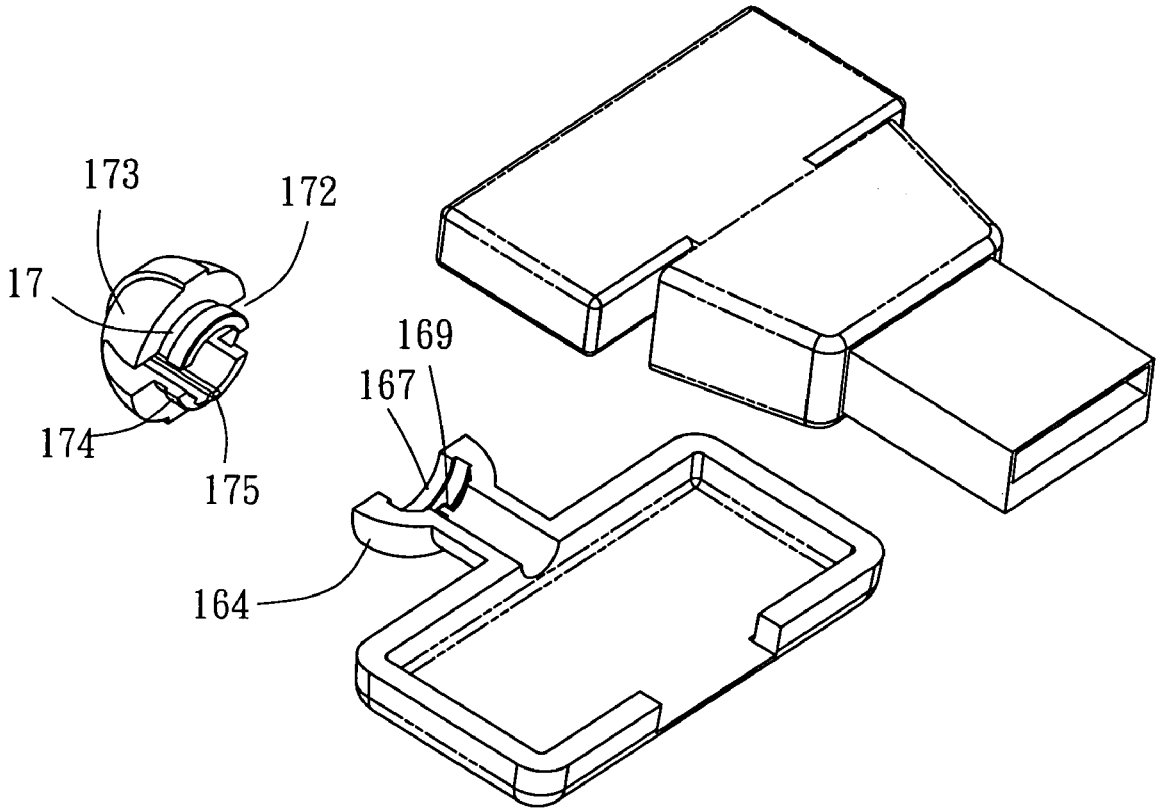
FIG. 8 illustrates an exploded view of a part of an alternate form of the electronic device according to the present invention.

FIG. 8 shows an alternate form of the present invention. According to this second embodiment, stop rods 169 and 175 are respectively provided inside the pivoting portion 164 and at the limiter 17 to limit the angle of rotation of the pivoting portion 164 (i.e., the coupling member 16) relative to the limiter 17, preventing overtwist of the electric wire, i.e., the connecting unit 10 can be rotated within 360° relative to the housing 21. Further, in order to reinforce the connection strength between the pivoting portion 164 and the limiter 17, the pivoting portion 164 is made having an inside annular flange 167 coupled to an outside annular groove 174 around the periphery of the tubular neck 173 of the limiter 17.

When connected the front connecting portion 13 of the connecting unit 10 to a corresponding port of a computer, signal from the computer is transmitted through the front connecting portion 13 to the electronic circuit assembly 22, and then modulated by the electronic circuit assembly 22 and transmitted to the outside wirelessly. When received an external wireless signal, the electronic circuit assembly 22 demodulates the signal and then transmits the demodulated signal to the front connecting portion 13 and then to the computer. The location or angle of the electronic circuit assembly 22 may have to be changed to fit the transmission or receiving of a wireless signal. In this case, the user can conveniently adjust the position of the body unit 20 relative to the computer to the desired angle.

The invention can be used in a wireless network receiver or wireless mouse receiver, as well as any of a variety of other electronic devices. For example, the electronic circuit assembly 22 can be a data storage circuit assembly to form a mobile memory stick; the electronic circuit assembly 22 can be an electric connector to form an electric adapter; the electronic circuit assembly 22 can be a socket terminal circuit assembly to form an electric outlet; the electronic circuit assembly 22 can be an electric plug terminal circuit assembly to form an electric plug.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An electronic device comprising:

a connecting unit having a connecting portion, which is disposed at one end thereof and detachably connectable to an external electronic device, and a pivoting portion disposed at an opposite end thereof, said pivoting portion having substantially a spherical contour; and a body unit having a housing and an electronic circuit assembly mounted inside said housing, said housing having a coupling structure for receiving said pivoting portion of said connecting unit for allowing free rotation of said pivoting portion relative to said housing, wherein said connecting unit further comprises a limiter pivotally coupled to said pivoting portion, and wherein said limiter comprises a rib at a periphery thereof; said coupling structure of said housing of said body unit comprises a locating groove, which receives the rib of said limiter to limit pivot motion of said limiter relative to said housing in a predetermined direction.

2. The electronic device as claimed in claim 1, wherein said connecting portion is a universal serial bus plug.

3. The electronic device as claimed in claim 1, wherein said connecting unit comprises a connecting member and an adapter, said connecting member having one end thereof terminating in said connecting portion and an opposite end thereof terminating in a mounting portion, said adapter comprising a hollow base and said pivoting portion, said pivoting portion extending from a back side of said hollow base, said mounting portion of said connecting member being affixed to said hollow base of said adapter.

4. The electronic device as claimed in claims 1, wherein said pivoting portion has an inside coupling flange; said limiter has a tubular neck perpendicularly extending from a flat bottom wall thereof and inserted into said pivoting portion, said tubular neck having an annular coupling groove extending around a periphery thereof and coupled to the inside coupling flange of said pivoting portion for allowing rotation of said limiter in said pivoting portion.

5. The electronic device as claimed in claims 1, wherein said limiter has at least one crevice for the passing of an electric wire.

6. The electronic device as claimed in claim 1, wherein said electronic circuit assembly comprises a wireless signal transmitter receiver circuit board for transmitting and receiving a wireless signal.

7. The electronic device as claimed in claim 1, wherein said coupling structure of said body unit comprises two bearing blocks for supporting said pivoting portion of said connecting unit, allowing rotation of said pivoting portion relative to said housing.

8. The electronic device as claimed in claims 1, wherein said pivoting portion has an inside stop rod, said limiter has an outside stop rod for stopping the inside stop rod of said pivoting portion to limit the angle of rotation of said pivoting portion relative to said limiter.

9. The electronic device as claimed in claim 1, wherein said electronic circuit assembly comprises a data storage device.

10. The electronic device as claimed in claim 1, wherein said electronic circuit assembly is an electronic connecting terminal.

11. The electronic device as claimed in claim 1, wherein said connecting portion is an electric socket terminal; said electronic circuit assembly is an electric socket circuit assembly.

12. The electronic device as claimed in claim 1, wherein said connecting portion is an electric plug terminal; said electronic circuit assembly is an electric cable.

* * * * *